US005755121A

United States Patent [19]

Crass

[11] Patent Number: 5,755,121

[45] Date of Patent: May 26, 1998

[54] LOCK BODY HAVING OPPOSING IDENTICAL MOLDED PLASTIC SECTIONS

[75] Inventor: Bruce Allen Crass, Glendale, Wis.

[73] Assignee: Master Lock Company, Milwaukee, Wis.

[21] Appl. No.: 681,422

[22] Filed: Jul. 23, 1996

[51] Int. Cl.[6] ..... E05B 67/02

[52] U.S. Cl. ..... 70/52; 70/38 A; 70/448

[58] Field of Search ..... 70/31, 38 A, 39, 70/51, 52, 462, 448, 449, 38 B, 38 C, 38 R

[56] References Cited

U.S. PATENT DOCUMENTS

| | | | |
|---|---|---|---|
| 301,291 | 7/1884 | Smith | 70/52 |
| 2,011,515 | 8/1935 | Fraim | 70/38 C |
| 3,499,301 | 3/1970 | Nilola et al. | 70/52 |
| 3,587,261 | 6/1971 | Berry | 70/52 |
| 4,112,715 | 9/1978 | Uyeda | 70/52 |
| 4,129,019 | 12/1978 | Urdal | 70/462 |
| 4,419,873 | 12/1983 | Sopko | 70/52 |
| 4,528,828 | 7/1985 | Poutiainen | 70/38 A |
| 5,275,027 | 1/1994 | Eklof et al. | 70/39 |

FOREIGN PATENT DOCUMENTS

| | | | |
|---|---|---|---|
| 2462536 | 3/1981 | France | 70/52 |
| 558349 | 12/1943 | United Kingdom | 70/52 |

*Primary Examiner*—Darnell M. Boucher
*Attorney, Agent, or Firm*—Pennie & Edmonds LLP

[57] ABSTRACT

A lock in which a key can neither be turned nor removed with the lock is open, is disclosed. The lock body is formed from two identical sections, the inner surface of each being provided with formations which accommodate the moving parts of the lock. The lock cylinder is provided with a plug which is operatively engaged to an extension. The lock shackle is engaged by a lock bearing which is held in place by the extension. Turning the key turns the plug and thus, the extension. This disengages the lock shackle as the lock bearing is no longer held in place. After it has been retracted, the contour of the lock shackle abuts the lock bearing, causing it to engage the extension, thus preventing the extension, the plug and the key from being turned.

18 Claims, 3 Drawing Sheets

LOCK BODY HAVING OPPOSING IDENTICAL MOLDED PLASTIC SECTIONS

BACKGROUND

The present invention relates to keyed locks. More particularly, it concerns locks wherein the key can neither be turned nor removed with the lock open, thus providing an extra measure of protection against accidental lockout.

SUMMARY OF THE INVENTION

The present invention is directed to a lock body which is formed from two identical molded sections having a number of integrally formed features. These features facilitate assembly of the lock and also help hold the lock's moving parts in place. Each section is formed from a plastic material, resulting in a strong, light weight device. Among the features belonging to each section are a recessed area on which labels can be placed, projections and holes for aligning two sections during assembly and a number of upstanding support structures, depressions and other formations for immobilizing, supporting and orienting the various moving parts. The lock body is also provided with a restricted key hole to resist tampering.

In a lock of the present invention, a lock shackle is provided with a first notch on the inside of its long leg, a neck near the end of the long leg, and a recessed inner surface between the notch and the neck. The neck is formed by a circumferential indentation which is shallower than the notch.

When the shackle is in the locked position, a lock bearing engages the notch and is held in place by a retaining member which is turned by the key. Thus, the lock bearing prevents the shackle from being retracted. Turning the key moves the retaining member, allowing the lock bearing to move out of the notch. With the lock bearing no longer held in place by the retaining member, an upward force on the shackle allows the shackle to be retracted, thus opening the lock.

With the shackle retracted, the lock bearing formerly engaging the notch on the shackle's long leg prevents the key from turning. This is because the lock bearing partially obstructs, and thus prevents, the retaining member from moving as the key is turned. When the short leg of the shackle is reinserted, the lock bearing reenters the notch of shackle's long leg and no longer prevents the retaining member from rotating as the key is turned.

An additional notch may be formed on the inside of the shackle's short leg, across from the first notch. In such case, a second lock bearing is used to engage the second notch, thus providing added strength to the lock's shackle retaining mechanism.

BRIEF DESCRIPTION OF THE DRAWINGS

The invention is best understood through the following figures in which.

DETAILED DESCRIPTION OF THE PREFERRED EMBODIMENT

Figure 1:
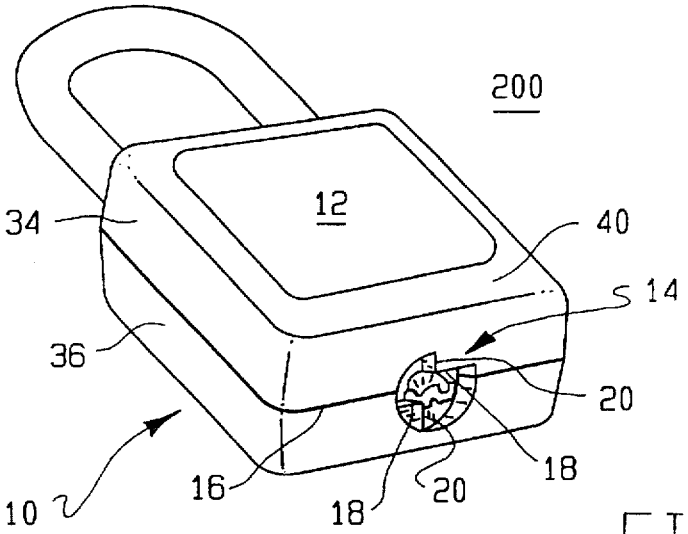
FIG. 1 is a perspective view of the lock shown in the locked position.

The lock 200 of the present invention has a lock body 10 which preferably is formed from a light weight plastic resin having good impact and chemical resistance. Plastic resins are both lighter and less expensive than steel. They are also well suited for prolonged use in hostile weather environments and can withstand large temperature variations. Furthermore, unlike most metals from which lock bodies are typically formed, plastic resins are nonconductive.

In the preferred embodiment, the lock body 10 is formed from XENOY™ made by General Electric, Co. This material has been selected for its strength, impact and chemical resistance and its low density. Other plastics may also be used for a lock body in accordance with the present invention.

The exterior of the lock body 10 is provided with a slightly recessed rectangular area 12. This area is suitable for placing a label or sticker carrying identifying information, instructions, and the like. The recessed area could, instead, be circular, triangular or square. Virtually any two-dimensional shape will suffice.

The lock body is further provided with a butterfly-shaped key hole 14 on its bottom face 16. The key hole is provided with a first and a second pair of abutments 18, 20 built into the lock body 10. These abutments, or key stops, restrict the rotation of the key. In the preferred embodiment, the key can only be rotated about 90° between the locked and unlocked positions until the haft of the key abuts one or the other pair of key stops 18, 20.

The lock body 10 is approximately ⅛ thick at its bottom where the key hole 14 is situated. This means that the entrance to the lock cylinder 22 is recessed by at least this distance with respect to the bottom face 16 of the lock body 10. The recessed, contoured key hole 14 provides an added measure of protection against picking and tampering with the lock.

Within the lock body is a lock cavity in which the lock's moving parts are housed. The moving parts include the lock cylinder 22, the lock shackle 24, spherical lock bearings 26, 28 and an extension member 30. The moving parts are held in place by the contoured inner surface 38 of the lock body 10.

The lock body 10 is formed from two identical halves, or sections 34, 36 formed from the aforementioned XENOY™ alloy. Each section is a single molded piece having a longitudinal axis A dividing the section into a left side and a right side, an inner surface 38 and an outer surface 40. The inner surface 38 is surrounded by a pair of side walls 42 and 44 and also a top 46 and a bottom wall 48.

The inner surface 38 comprises a number of integrally formed features. These features facilitate assembly of the lock, help in joining one section to another, and/or hold the moving members in place once the lock is assembled. Using two identical sections simplifies manufacturing as items of only one kind need be manufactured and kept on hand for assembly.

Each section is provided with integrally formed locator posts 50, 52 and receiving holes 54, 56. The posts on one section mate with holes on an opposing section. The posts and holes help align the two sections during assembly. The first 50 of the two locator posts is formed on the edge 58 of the section's top wall 46, about midway between the longitudinal axis A and the side wall 42. The first locator post 50 mates with a first hole (on an opposing section) which is situated on the edge 58, about midway between the longitudinal axis A and the other side wall 44 of the section. The second locator post 52 is situated near the bottom wall 48 of the section close to the side wall 42 and mates with a complementary receiving hole 56 near the bottom wall 48 close to an opposing sections' other side wall 44.

Two pairs of tongue-and-groove members are also formed in each section to aid in the assembly of the lock body. The tongue-and-groove members also serve as energy directors when the two sections are ultrasonically welded together.

The groove member 60 of the first of these pairs is L-shaped, with one leg 62 extending along a one side edge 64 of the lock section and a second leg 66 running along one side of the bottom edge 68. This groove's complementary tongue member 70 has a first leg 72 which extends along the other side edge 74 and a second leg 76 extending along the other side of the bottom edge 68.

The second pair of tongue-and-groove members is found in a central area of the top edge 58. In this second pair, the groove 78 extends from the middle of the top edge 58 part way in the direction of the side edge 64. The tongue member 80 similarly extends from the middle of the top edge 58 part way towards the other side edge 74. Thus, tongue-and-groove members are present on all four edges of the section.

Figure 8:
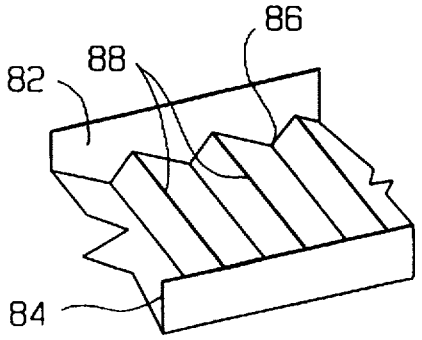
FIG. 8 shows a detailed view of a groove member.

As shown in FIG. 8, each of the groove members has a pair of groove side walls 82, 84 and a base portion 86. The base portions of the groove members are provided with serrations 88. Preferably, the lock body is formed by ultrasonically welding together two opposing sections. During this process, the tongue members and the groove members fuse together as at least a portion of the tongue members melt. The serrations in the groove members accommodate plastic resin when it softens and flows during welding operations. The serrations can, alternatively, accommodate excess adhesive, when used either in place of, or to supplement, the ultrasonic welding.

It should be noted that in the preferred embodiment, the posts 50, 52 which help align the two sections during assembly, are taller than the tongue members 70, 80, which aid in sealing the lock body.

Figure 2:
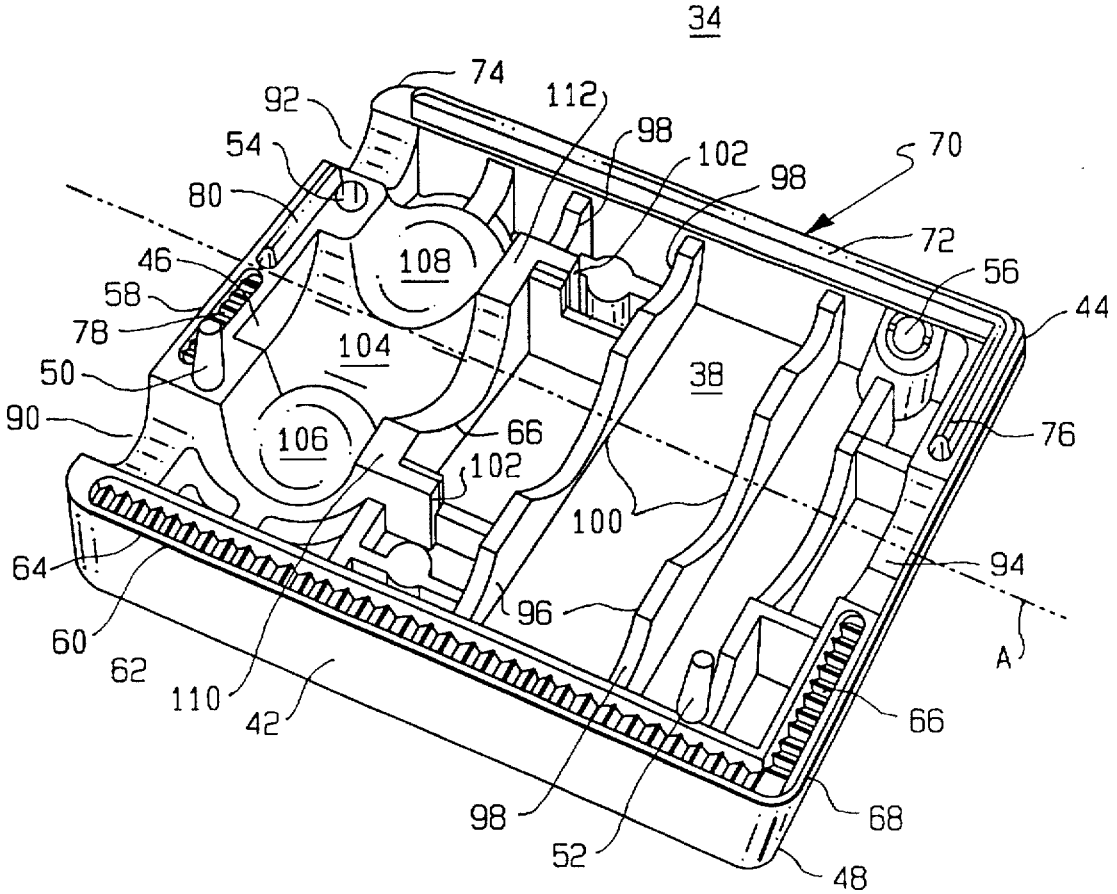
FIG. 2 is a perspective view of the interior of one section from which the lock body is formed.

Each section is provided with two spaced apart semi-circular shackle cutouts 90, 92 at its top edge 58, proximate to the side edges. These cutouts are symmetrically disposed about the longitudinal axis A of the section. In an assembled lock body, opposing pairs of cutouts form shackle opening which are occupied by the legs of the "J"-shaped lock shackle 24 when the shackle is in the locked position. As shown in FIG. 2, the shackle cutouts in the section 34 border the tongue-and-groove members situated on the top edge 58.

Each section is also provided with a central cutout 94 on its bottom edge. The central cutout forms one-half of the butterfly-shaped key hole 14. When the lock is assembled, one central cutout is mated with its reversed image on an opposing section to form a single butterfly-shaped key hole 14 having the aforementioned pair of key stops.

The inner surface of each section is formed with a number of upstanding support structures 96 which help support, immobilize and orient various lock components. Included among these structures are two rows of small support ribs 98, each row aligned with one of the semi-circular shackle cutouts 90, 92 formed on the top edge. Each row runs parallel to adjacent side edges of the section and is shaped to receive one leg of the lock shackle. The second locator post 52 is situated at the end of one of the two rows, away from the semi-circular shackle cutout. This locator post 52 serves as a stop for the long leg 132 of the lock shackle 24, ensuring that the latter does not descend too far into the lock body 10.

Each section is also provided with a single central row of large support ribs 100. The row of large support ribs runs from the bottom edge of the section interior near the central cutout for the key hole 14, to about two-thirds of the way up. The central row of large support ribs 100 is shaped and sized to accommodate the lock cylinder 22. The cylinder rests on this row and against the inside surface of the central cutout. A pair of housing stops 102 integrally formed with the section prevents the cylinder body from shifting upwards.

Also formed integrally with each section, is a concave formation 104 arranged to receive and hold in place a cylindrical extension to the lock cylinder. As shown in FIG. 2, the concave formation is in the form of a first channel extending along a portion of the longitudinal axis A. It extends from the abutments 110, 112 formed on the inner surface 38 to the upper wall 46 of the section 34.

On either side of the curved formation are two shallow bowl-shaped depressions 106, 108, also situated above the roof member in the upper portion of the section interior. These depressions are formed from a second channel which is arranged transversely with respect to the first channel and cuts across the longitudinal axis A. These depressions are sized to accommodate the lock bearings 26, 28 which engage the notches in the lock shackle. With the lock assembled and in the locked position, the lock bearings are held in support areas between opposing pairs of depressions, bounded on one side by the extension 30, and on the other by the lock shackle 34, as shown in FIG. 3.

A further feature of each section is a pair of L-shaped welding abutments 110, 112 just below each bowl-shaped depression. The welding abutments are taller than any of the rows of support ribs. However, the welding abutments do not extend as far up from the section as do either the tongue members or the locator posts. The welding abutments are positioned in a central area of the section, away from the section's edges and thus, the tongue-and-groove members. The welding abutments abut one another when the two sections are brought together and the tongue-and-groove members are fused during ultrasonic welding operations. Thus, the welding abutments prevent the two sections from being forced too close to one another and interfering with normal locking and unlocking operations. In effect, the welding abutments serve to keep opposing ribs separated by a minimum predetermined distance.

Figure 3:
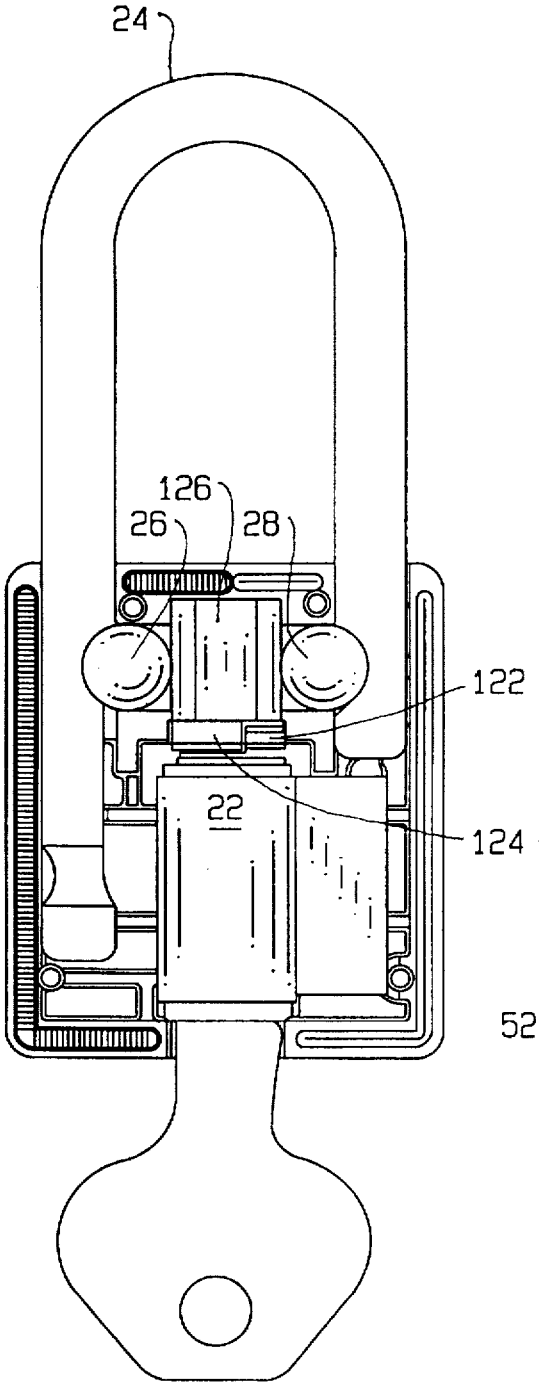
FIG. 3 is a top view of the movable parts shown in the locked position.
Figure 6:
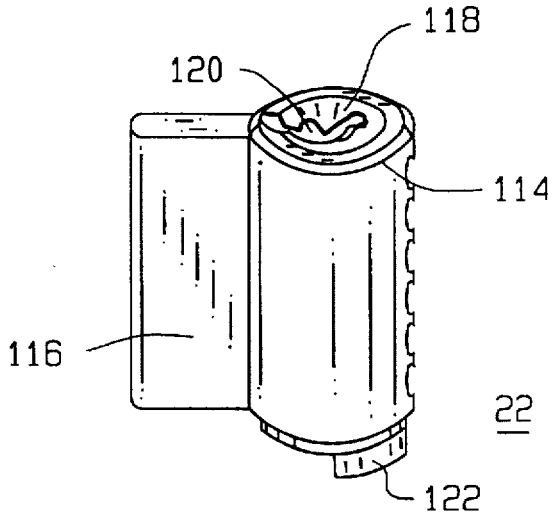
FIG. 6 is a view of the lock cylinder.
Figure 7:
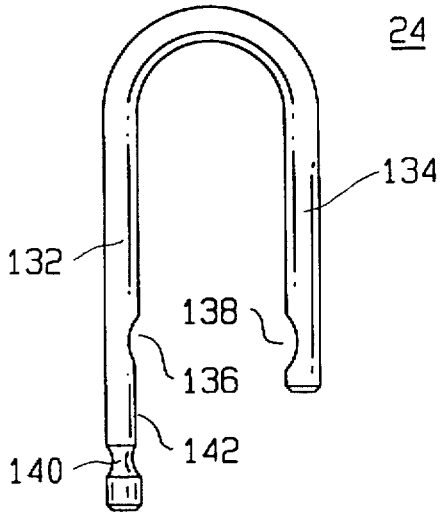
FIG. 7 is a view of the lock shackle.

FIG. 3 shows the moving parts of the lock in a section as they appear when the lock is locked. As shown in FIG. 6, the lock cylinder has a shell 114 having an integrally formed pin housing 116. The cylinder also has plug 118 which has a keyway 120 at one end for receiving a key. At least a portion of the plug is housed within the shell 114. At the other end of the plug, away from the keyway, is an integrally formed plug projection 122. The plug and plug projection turn with the key.

Figure 5:
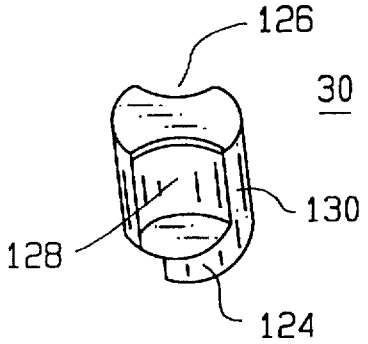
FIG. 5 is a view of the extension.

Shown above the cylinder in FIG. 3 is an extension 30 which lays in the formation between the two depressions 106, 108. In an assembled lock, the extension 30 is positioned in an extension cavity formed by opposing formations. As shown in FIG. 5, the extension 30 is substantially cylindrical and is formed with an extension projection 124 at one end. The extension projection complements the plug projection 122 formed on the cylinder plug 118. When a key turns the cylinder plug, the plug and plug projection rotate along the longitudinal axis A. During this motion, the plug projection abuts and then turns the extension 30.

As is known to those skilled in the art, the complementary abutting projections on the plug and extension can be replaced, for instance, by complementary male and female members formed on these components. The plug and extension could, instead, be formed as a single piece which performs the functions of both. Alternatively, they could comprise a number of operatively engaged elements which collectively perform these same functions.

The extension is also formed with a pair of arc-shaped undercuts 126, 128 on its cylindrical side wall 130. The undercuts are preferably sized and shaped so as conform to the lock bearings 26, 28. With the lock in the locked position, the undercuts are at right angles to the lock bearings. In this position, one side of each lock bearing occupies a shackle notch 136, 138 while the other side is held in place by the cylindrical wall 130 of the extension. With the lock bearings held in this position, the shackle 24, cannot be retracted.

The shackle is formed with a long leg 132 and a short leg 134. In the preferred embodiment, each leg is provided with a notch 136, 138 formed on the inner leg's surface. The curve of each notch 136, 138 is similar to the curve of the extension's undercuts 126, 128. Near its end, the shackle's long leg 132 is also provided with a radially symmetric neck portion 140 having a circumferential indent. Extending between the notch and the neck on the long leg is a recessed, flat area 142 on the long leg's inner surface. This area is recessed relative to the cylindrical contour of the long leg 132. The long leg's notch 136, however, is deeper than either the recessed flat area 142 or the neck's 140 circumferential indent.

The lock bearings 26, 28 are spherical metallic balls, which also could be plastic or ceramic, sized to fit the contour of the extension's undercuts as well as the shackle's notches. With the shackle 24 in the locked position, the bearings are held between the shackle notches and the cylindrical wall 130 of the extension 30. With the shackle retracted, the lock bearings remain close to the aforementioned depressions in the section, but are able to move around somewhat.

To unlock the lock, the key is inserted into the plug 118 of the cylinder 22 through the restricted key hole 14. Once the notches of key match with the corresponding tumbler pins in the cylinder, the proper shear line between the plug 118 and shell 114 of the cylinder is achieved. This allows the key, cylinder plug 118 and extension 30 to rotate to key stops 20. Preferably the key is rotated about 90° to effect the unlocking.

Figure 4:
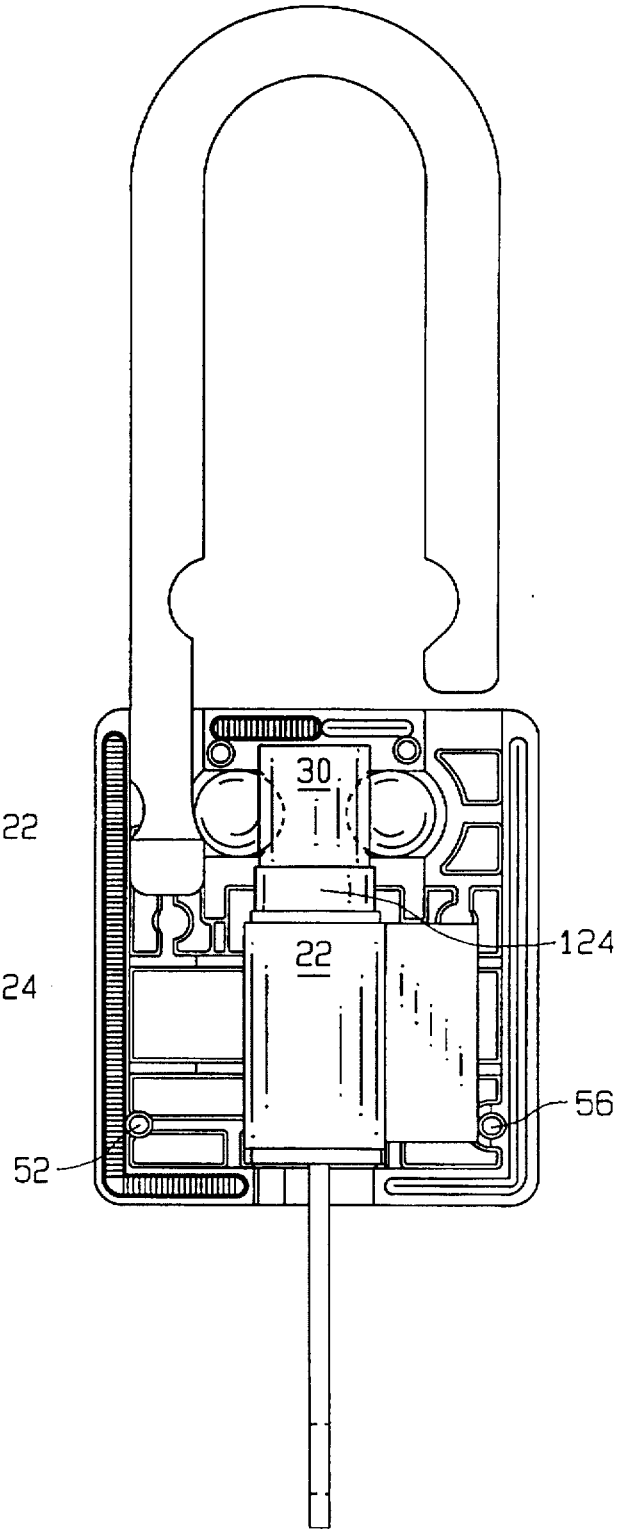
FIG. 4 is a top view of the movable part shown in the unlocked position.

When the key is turned to unlock the lock, the plug 118 and the extension 30 also make a quarter turn. This causes the undercuts 126, 128 to become aligned with the lock bearings. When the extension and undercuts are in this position and a force is applied to retract the shackle out of the lock body, the lock bearings 26, 28 are cammed out of the notches 136, 138 of the shackle 24 and engage the undercuts of the extension. This allows clear passage of the short leg 134 from the lock body. Once unlocked as shown in FIG. 4, the shackle can be rotated 360° about the shackle's long leg, which is still retained in the lock body 10.

With the shackle 24 retracted, the lock bearing 26 abuts either the recessed area 142 or the neck 140 of the long leg. As these two features are not as deep as the notch 136, the lock bearing 26 at least partially enters the undercut 128. If one were now to turn the key, the lock bearing 26 would become wedged between an inner wall of the undercut 128 and the flat surface 142 of the long leg 132 of the shackle. This prevents the key from being turned.

To lock the lock, the short leg 134 of the shackle 24 must be inserted into the lock body. This allows the lock bearing 26 to enter the long leg's notch so that it no longer occupies the undercut 128. Under these conditions, the extension 30, and thus, the key, may be turned without interference from the lock bearing 26.

While it is preferable to have notches on both shackle legs, the notch 138 on the short leg 134 is not absolutely critical to practice the invention. One may eliminate the notch 138 on the short leg, its corresponding lock bearing 28 and corresponding undercut 126 on the extension 30. Then, only the long leg 132 will have a notch 136 and there will be a single lock bearing 26 and a single undercut 128 formed in the extension. And, as stated above, the extension could be integrally formed with the cylinder plug, reducing the number of moving components.

Assembly of a lock is fairly straightforward. A first section 36 is laid on a flat surface, the section's inner surface facing 38 up. The shackle 24, lock cylinder 22 and extension 30 are then placed on those interior features shaped to accommodate them, the shackle being in the inserted position. With the shackle inserted, the cylinder 22 can only be placed in one way, the pin housing 116 being situated under the short leg 134 of the shackle 24, as shown in FIG. 3. Next, the lock bearings 26, 28 are placed between the extension 30 and the shackle notches 136, 138. Then, a second section 34 is laid over the moving parts and aligned with the first section 36. The two sections are then ultrasonically welded, forming the lock 200. This assembly process contrasts with prior art techniques in which one takes a lock body already having a shackle and lock cylinder in place, drilling holes into the body, placing lock bearings or the like in predetermined locations, and then sealing the drilled holes.

While there has been described what is at present considered to be a preferred embodiment of this invention, it will be clear to those skilled in art that various changes and modifications may be made without departing from the invention which is intended to cover all such changes and modifications as fall within the true spirit and scope of the claims set forth hereunder.

What is claimed is:

1. A lock body structure of a lock comprising:

first and second sections formed from identical parts each comprising a single piece of molded plastic, each of said sections having a longitudinal axis, an outer surface, an inner surface and upstanding walls surrounding said inner surface and terminating in wall edges, said wall edges of said first and second sections adapted to abut each other to define a lock cavity between said first and second sections with said inner surfaces facing each other;

a plurality of upstanding support structures integrally formed on the inner surface of each of said first and second sections, said support structures on said first section directly opposing, and spaced apart from complementary support structures on said second section when the wall edges of said first and second sections abut each other, and defining a plurality of spaces of predetermined distance therebetween for accommodating movable lock components which move with respect to said support structures during operation of said lock;

a pair of spaced apart lock shackle openings defined by a pair of lock shackle cutouts integrally formed on one of said walls of each of said first and second sections with the first section lock shackle cutouts facing the second section lock shackle cutouts when said wall edges abut each other; and a key hole defined by a key hole cutout integrally formed on one of said walls of each of said first and second sections with the first section key hole cutout facing the second section key hole cutout when said wall edges abut each other.

2. The lock body structure of claim 1 wherein said first and second key hole cutouts form a first and a second pair of key abutments, said first pair of key abutments configured to stop the rotation of a key in a first direction and said second pair of abutments configured to stop the rotation of a key in a second direction, when said first section edges abut said second section edges and a key is inserted into said key hole.

3. A lock body structure comprising:

first and second sections formed from identical parts, each comprising a single piece of molded plastic, each of said sections having a longitudinal axis, an outer surface, an inner surface and upstanding walls surrounding said inner surface and terminating in wall edges, said wall edges of said first and second sections adapted to abut each other to define a lock cavity between said first and second sections with said inner surfaces facing each other;

a plurality of upstanding support structures integrally formed on the inner surface of each of said first and second sections, said support structures on said first section being spaced from support structures on said second section when the wall edges of said first and second sections abut each other, and defining a plurality of spaces of predetermined distance therebetween for accommodating movable lock components;

a pair of spaced apart lock shackle openings defined by a pair of lock shackle cutouts integrally formed on one of said walls of each of said first and second sections with the first section lock shackle cutouts facing the second section lock shackle cutouts when said wall edges abut each other;

a key hole defined by a key hole cutout integrally formed on one of said walls of each of said first and second sections with the first section key hole cutout facing the second section key hole cutout when said wall edges abut each other; and at least one tongue member of a first height extending along one of said first section edges and at least one groove member extending along one of said second section edges, said tongue member opposing said groove member when said first section edges abut said second section edges.

4. The lock body structure of claim 3 further comprising a post formed on said first section edge and a complementary hole formed on said second section edge, said post having a second height exceeding said first height, said post opposing said complementary hole when said first section edges abut said second section edges.

5. The lock body structure of claim 1 wherein said first section further comprises a first and a second abutment formed away from the edge walls of said first inner surface, said first abutment positioned across said longitudinal axis of said first section from said second abutment, and said second section further comprises a third and a fourth abutment formed away from said edge walls of said second inner surface, said third abutment positioned across said longitudinal axis of said second section from said fourth abutment, said first abutment opposes said fourth abutment and said second abutment opposes said third abutment when said first section edges abut said second section edges, and said first and fourth abutments and said second and third abutments maintain a minimum predetermined distance between said upstanding support structures on opposing first and second sections when said first abutment abuts said fourth abutment and said second abutment abuts said third abutment.

6. A lock body structure comprising:

first and second sections formed from identical parts, each comprising a single piece of molded plastic, each of said sections having a longitudinal axis, an outer surface, an inner surface and upstanding walls surrounding said inner surface and terminating in wall edges, said wall edges of said first and second sections adapted to abut each other to define a lock cavity between said first and second sections with said inner surfaces facing each other;

a plurality of upstanding support structures integrally formed on the inner surface of each of said first and second sections, said support structures on said first section being spaced from support structures on said second section when the wall edges of said first and second sections abut each other, and defining a plurality of spaces of predetermined distance therebetween for accommodating movable lock components;

a pair of spaced apart lock shackle openings defined by a pair of lock shackle cutouts integrally formed on one of said walls of each of said first and second sections with the first section lock shackle cutouts facing the second section lock shackle cutouts when said wall edges abut each other;

a key hole defined by a key hole cutout integrally formed on one of said walls of each of said first and second sections with the first section key hole cutout facing the second section key hole cutout when said wall edges abut each other;

each of said first and second sections further comprises a first channel formed along a first portion of the longitudinal axis and a second channel formed transversely across the first channel and cutting across the longitudinal axis; and the first and second channels of said first section opposing the first and second channels of said second section to form spaces of a predetermined distance therebetween to accommodate moving lock components when said first section edges abut said second section edges.

7. A lock movable between a locked and an unlocked state, said lock comprising:

a lock body formed from identical first and second sections, each section comprising a single piece of molded plastic, said first section having a first longitudinal axis, a first outer surface, a first inner surface, first section walls surrounding said first inner surface and first section edges formed on said first section walls, said second section having a second longitudinal axis, a second outer surface, a second inner surface, second section walls surrounding said second inner surface and second section edges formed on said second section walls, said first section edges abutting said second section edges to define a lock cavity between said first and second sections with said first inner surface facing said second inner surface;

a key hole formed in said lock body by facing first and second key hole cutouts, said first key hole cutout formed in one of said first section walls and said second key hole cutout formed in one of said second section walls, spaced apart first and second shackle openings formed in said lock body by facing first and second pairs of shackle cutouts, said first pair of shackle cutouts formed on one of said first section walls and said second pair of shackle cutouts formed on an opposing one of said second section walls;

a lock shackle movable between an inserted and a retracted position, said lock shackle having a first shackle leg occupying said first shackle opening and a second shackle leg occupying said second shackle opening when said lock shackle is in said inserted position;

a plurality of lock components housed within said lock body and operatively engaged to said lock shackle to allow said shackle to be moved between said inserted and retracted positions upon rotation of a key inserted into one of said lock components through said key hole;

a plurality of upstanding support structures integrally formed on each of said inner surfaces, said support structures on said first inner surface directly opposing and spaced apart from complementary support structures on said second inner surface to define a plurality of spaces of predetermined dimension therebetween for accommodating movable lock components; and at least some of said lock components being mounted on the upstanding support structures for movement relative to said support structures.

8. The lock of claim 7 further comprising a lock cylinder having a cylinder plug extending along a first portion of said first and second longitudinal axes, said cylinder plug mounted on said support structures for rotation along said axes when a key inserted into said plug through said key hole is turned, said first and second shackle legs and said lock cylinder occupying said plurality of spaces.

9. A lock movable between a locked and an unlocked state, said lock comprising:

a lock body formed from identical first and second sections, each section comprising a single piece of molded plastic, said first section having a first longitudinal axis, a first outer surface, a first inner surface, first section walls surrounding said first inner surface and first section edges formed on said first section walls, said second section having a second longitudinal axis, a second outer surface, a second inner surface, second section walls surrounding said second inner surface and second section edges formed on said second section walls, said first section edges abutting said second section edges to define a lock cavity between said first and second sections with said first inner surface facing said second inner surface;

a key hole formed in said lock body by facing first and second key hole cutouts, said first key hole cutout formed in one of said first section walls and said second key hole cutout formed in one of said second section walls;

spaced apart first and second shackle openings formed in said lock body by facing first and second pairs of shackle cutouts, said first pair of shackle cutouts formed on one of said first section walls and said second pair of shackle cutouts formed on an opposing one of said second section walls;

a lock shackle movable between an inserted and a retracted position, said lock shackle having a first shackle leg occupying said first shackle opening and a second shackle leg occupying said second shackle opening when said lock shackle is in said inserted position;

a plurality of lock components housed within said lock body and operatively engaged to said lock shackle to allow said shackle to be moved between said inserted and retracted positions upon rotation of a key inserted into one of said lock components through said key hole;

a plurality of upstanding support structures integrally formed on each of said inner surfaces, said support structures on said first inner surface being spaced from and opposing support structures on said second inner surface to define a plurality of spaces of predetermined dimension therebetween;

a lock cylinder having a cylinder plug extending along a first portion of said first and second longitudinal axes, said cylinder plug mounted for rotation along said axes when a key inserted into said plug through said key hole is turned;

said first and second shackle legs and said lock cylinder occupying said plurality of spaces;

each of said first and second sections further comprises a first channel formed along a second portion of respective first and second longitudinal axes; and the first channel of said first section opposes the first channel of the second section to define an extension cavity therebetween with an extension member positioned in said extension cavity, said extension member rotating with said cylinder plug when a key inserted into said cylinder plug through said key hole is turned.

10. The lock of claim 9 wherein each of said first and second sections further comprises a second channel formed transversely across the first channel and cutting across respective first and second longitudinal axes, the second channel of said first section opposing the second channel of the second section to define a pair of spaced apart bearing support spaces therebetween;

first and second shackle engaging members are movably positioned in said bearing support spaces;

a first notch is formed in said first shackle leg and a second notch is formed in said second shackle leg; and said first and second shackle engaging members engage respective said first and second notches when said lock is in said locked state.

11. The lock of claim 8 wherein said first section further comprises a first and a second abutment formed away from said edge walls of said first inner surface, said first and second abutments being separate from said plurality of upstanding support structures;

said second section further comprises a third and a fourth abutment formed away from said edge walls of said second inner surface, said third and fourth abutments being separate from said plurality of upstanding support structures; and said first abutment opposes said fourth abutment and said second abutment opposes said third abutment.

12. A lock movable between a locked and an unlocked state, said lock comprising:

a lock body formed from identical first and second sections, each section comprising a single piece of molded plastic, said first section having a first longitudinal axis, a first outer surface, a first inner surface, first section walls surrounding said first inner surface and first section edges formed on said first section walls, said second section having a second longitudinal axis, a second outer surface, a second inner surface, second section walls surrounding said second inner surface and second section edges formed on said second section walls, said first section edges abutting said second section edges to define a lock cavity between said first and second sections with said first inner surface facing said second inner surface;

a key hole formed in said lock body by facing first and second key hole cutouts, said first key hole cutout formed in one of said first section walls and said second key hole cutout formed in one of said second section walls;

spaced apart first and second shackle openings formed in said lock body by facing first and second pairs of shackle cutouts, said first pair of shackle cutouts formed on one of said first section walls and said second pair of shackle cutouts formed on an opposing one of said second section walls;

a lock shackle movable between an inserted and a retracted position, said lock shackle having a first shackle leg occupying said first shackle opening and a second shackle leg occupying said second shackle opening when said lock shackle is in said inserted position;

a plurality of lock components housed within said lock body and operatively engaged to said lock shackle to allow said shackle to be moved between said inserted and retracted positions upon rotation of a key inserted into one of said lock components through said key hole;

a plurality of upstanding support structures integrally formed on each of said inner surfaces, said support structures on said first inner surface being spaced from and opposing support structures on said second inner surface to define a plurality of spaces of predetermined dimension therebetween;

a lock cylinder having a cylinder plug extending along a first portion of said first and second longitudinal axes, said cylinder plug mounted for rotation along said axes when a key inserted into said plug through said key hole is turned;

said first and second shackle legs and said lock cylinder occupying said plurality of spaces;

said first section further comprises a first and a second abutment formed away from said edge walls of said first inner surface;

said second section further comprises a third and a fourth abutment formed away from said edge walls of said second inner surface;

said first abutment opposes said fourth abutment and said second abutment opposes said third abutment;

at least one tongue member extending along one of said first section edges and at least one groove member extending along one of said second section edges, said tongue member being inserted into said groove member with at least a portion of said tongue member being melted; and wherein at least one of said first and fourth abutments and said second and third abutments abut each other so as to maintain a minimum predetermined distance between said upstanding support structures on opposing first and second sections.

13. The lock of claim 7 wherein said first and second key hole cutouts form a first and a second pair of key abutments, said first pair of key abutments configured to stop the rotation of a key in a first direction and said second pair of abutments configured to stop the rotation of a key in a second direction, when said first section edges abut said second section edges and a key is inserted into said key hole.

14. A padlock movable between a locked and an unlocked state, said padlock comprising:

a padlock body formed from identical first and second sections, each section comprising a single piece of molded plastic, said first section having a first longitudinal axis, a first outer surface, a first inner surface, first section walls surrounding said first inner surface and first section edges formed on said first section walls, said second section having a second longitudinal axis, a second outer surface, a second inner surface, second section walls surrounding said second inner surface and second section edges formed on said second section walls, said first section edges abutting said second section edges to define a lock cavity between said first and second sections with said first inner surface facing said second inner surface;

a key hole formed in said padlock body by facing first and second key hole cutouts, said first key hole cutout formed in one of said first section walls and said second key hole cutout formed in one of said second section walls, said cutouts being shaped so as to provide the key hole with a first pair of key abutments configured to stop the rotation of a key in a first direction and said second pair of abutments configured to stop the rotation of a key in a second direction, when a key is inserted into said key hole;

spaced apart first and second shackle openings formed in said padlock body by facing first and second pairs of shackle cutouts, said first pair of shackle cutouts formed on one of said first section walls and said second pair of shackle cutouts formed on an opposing one of said second section walls;

a lock shackle movable between an inserted and a retracted position, said lock shackle having a first shackle leg occupying said first shackle opening and a second shackle leg occupying said second shackle opening when said lock shackle is in said inserted position;

a plurality of lock components housed within said padlock body and operatively engaged to said lock shackle to allow said shackle to be moved between said inserted and retracted positions upon rotation of a key inserted into one of said lock components through said key hole;

a plurality of upstanding support structures integrally formed on each of said inner surfaces, said support structures on said first inner surface directly opposing, and spaced apart from complementary structures on said second inner surface to define a plurality of spaces of predetermined dimension therebetween; and a lock cylinder having a cylinder plug extending along a first portion of said first and second longitudinal axes, said cylinder plug rotatably mounted on said support structures for rotation along said axes when a key inserted into said plug through said key hole, is turned.

15. A padlock movable between a locked and an unlocked state, said padlock comprising:

a padlock body formed from identical first and second sections, each section comprising a single piece of molded plastic, said first section having a first longitudinal axis, a first outer surface, a first inner surface, first section walls surrounding said first inner surface and first section edges formed on said first section walls, said second section having a second longitudinal axis, a second outer surface, a second inner surface, second section walls surrounding said second inner surface and second section edges formed on said second section walls, said first section edges abutting said second section edges to define a lock cavity between said first and second sections with said first inner surface facing said second inner surface;

a key hole formed in said padlock body by facing first and second key hole cutouts, said first key hole cutout formed in one of said first section walls and said second key hole cutout formed in one of said second section walls, said cutouts being shaped so as to provide the key hole with a first pair of key abutments configured to stop the rotation of a key in a first direction and said second pair of abutments configured to stop the rotation of a key in a second direction, when a key is inserted into said key hole;

spaced apart first and second shackle openings formed in said padlock body by facing first and second pairs of shackle cutouts, said first pair of shackle cutouts formed on one of said first section walls and said second pair of shackle cutouts formed on an opposing one of said second section walls;

a lock shackle movable between an inserted and a retracted position, said lock shackle having a first shackle leg occupying said first shackle opening and a second shackle leg occupying said second shackle opening when said lock shackle is in said inserted position;

a plurality of lock components housed within said padlock body and operatively engaged to said lock shackle to allow said shackle to be moved between said inserted and retracted positions upon rotation of a key inserted into one of said lock components through said key hole;

a plurality of upstanding support structures integrally formed on each of said inner surfaces, said support structures on said first inner surface being spaced from and opposing support structures on said second inner surface to define a plurality of spaces of predetermined dimension therebetween;

a lock cylinder having a cylinder plug extending along a first portion of said first and second longitudinal axes, said cylinder plug mounted for rotation along said axes when a key inserted into said plug through said key hole, is turned;

each of said first and second sections further comprises a first channel formed along a second portion of respective first and second longitudinal axes; and the first channel of said first section opposes the first channel of said second section to define an extension cavity therebetween with an extension member positioned in said extension cavity, said extension member rotating with said cylinder plug when a key inserted into said cylinder plug through said key hole, is turned.

16. The padlock of claim 15 wherein each of said first and second sections further comprises a second channel formed transversely across the first channel and cutting across respective first and second longitudinal axes, the second channel of said first section opposing the second channel of the second section to define a pair of spaced apart bearing support spaces therebetween;

first and second shackle engaging members are movably positioned in said bearing support spaces;

a first notch is formed in said first shackle leg and a second notch is formed in said second shackle leg; and said first and second shackle engaging members engage respective said first and second notches when said padlock is in said locked state.

17. The padlock of claim 14, wherein said first section further comprises a first and a second abutment formed away from said edge walls of said first inner surface, said first and second abutments being separate from said plurality of upstanding support structures;

said second section further comprises a third and a fourth abutment formed away from said edge walls of said second inner surface, said third and fourth abutments being separate from said plurality of upstanding support structures; and said first abutment opposes said fourth abutment and said second abutment opposes said third abutment.

18. A padlock movable between a locked and an unlocked state, said padlock comprising:

a padlock body formed from identical first and second sections, each section comprising a single piece of molded plastic, said first section having a first longitudinal axis, a first outer surface, a first inner surface, first section walls surrounding said first inner surface and first section edges formed on said first section walls, said second section having a second longitudinal axis, a second outer surface, a second inner surface, second section walls surrounding said second inner surface and second section edges formed on said second section walls, said first section edges abutting said second section edges to define a lock cavity between said first and second sections with said first inner surface facing said second inner surface;

a key hole formed in said padlock body by facing first and second key hole cutouts, said first key hole cutout formed in one of said first section walls and said second key hole cutout formed in one of said second section walls, said cutouts being shaped so as to provide the key hole with a first pair of key abutments configured to stop the rotation of a key in a first direction and said second pair of abutments configured to stop the rotation of a key in a second direction, when a key is inserted into said key hole;

spaced apart first and second shackle openings formed in said padlock body by facing first and second pairs of shackle cutouts, said first pair of shackle cutouts formed on one of said first section walls and said second pair of shackle cutouts formed on an opposing one of said second section walls;

a lock shackle movable between an inserted and a retracted position, said lock shackle having a first shackle leg occupying said first shackle opening and a second shackle leg occupying said second shackle opening when said lock shackle is in said inserted position;

a plurality of lock components housed within said padlock body and operatively engaged to said lock shackle to allow said shackle to be moved between said inserted and retracted positions upon rotation of a key inserted into one of said lock components through said key hole;

a plurality of upstanding support structures integrally formed on each of said inner surfaces, said support structures on said first inner surface being spaced from and opposing support structures on said second inner surface to define a plurality of spaces of predetermined dimension therebetween;

a lock cylinder having a cylinder plug extending along a first portion of said first and second longitudinal axes, said cylinder plug mounted for rotation along said axes when a key inserted into said plug through said key hole, is turned;

said first section further comprises a first and a second abutment formed away from said edge walls of said first inner surface;

said second section further comprises a third and a fourth abutment formed away from said edge walls of said second inner surface;

said first abutment opposes said fourth abutment and said second abutment opposes said third abutment;

at least one tongue member extending along one of said first section edges and at least one groove member extending along one of said second section edges, said tongue member being inserted into said groove member with at least a portion of said tongue member being melted; and wherein at least one of said first and fourth abutments and said second and third abutments abut each other so as to maintain a minimum predetermined distance between said upstanding support structures on opposing first and second sections.

* * * * *